US005855991A

United States Patent [19]

McLarty, III

[11] Patent Number: 5,855,991

[45] Date of Patent: Jan. 5, 1999

[54] COMPOSITE TEXTILE STRUCTURE

[75] Inventor: George C. McLarty, III, Greenville, S.C.

[73] Assignee: Milliken Research Corporation, Spartanbur, S.C.

[21] Appl. No.: 886,848

[22] Filed: Jul. 1, 1997

Related U.S. Application Data

[63] Continuation of Ser. No. 744,176, Nov. 5, 1996, abandoned.

[51] Int. Cl.[6] ..... B32B 3/00

[52] U.S. Cl. ..... 428/195; 5/952; 428/196; 428/197; 428/421; 442/183; 442/184; 442/255; 442/260; 442/304

[58] Field of Search ..... 428/195, 196, 428/197, 421, 422; 442/304, 183, 184, 255, 260; 5/952

[56] References Cited

U.S. PATENT DOCUMENTS

| | | | |
|---|---|---|---|
| 2,184,772 | 12/1939 | Vamos . | |
| 2,251,318 | 8/1941 | Blair et al. . | |
| 4,469,738 | 9/1984 | Himelreich | 428/198 |
| 4,469,739 | 9/1984 | Gretzinger et al. | 428/198 |
| 4,545,614 | 10/1985 | Abu-Isa et al. | 297/284 |
| 4,554,205 | 11/1985 | Mahr | 428/253 |
| 4,869,554 | 9/1989 | Abu-Isa et al. | 297/452 |
| 5,013,089 | 5/1991 | Abu-Isa et al. | 297/452 |
| 5,424,110 | 6/1995 | Tornero et al. | 428/114 |
| 5,447,462 | 9/1995 | Smith et al. | 450/122 |
| 5,457,968 | 10/1995 | McClintock et al. | 66/202 |
| 5,533,789 | 7/1996 | McLarty et al. | 297/452.64 |
| 5,565,265 | 10/1996 | Rubin et al. | 428/265 |

*Primary Examiner*—James J. Bell

*Attorney, Agent, or Firm*—Terry T. Moyer; James M. Robertson

[57] ABSTRACT

A composite textile structure is provided. the composite structure includes a woven base fabric of elastomeric yarns wherein the yarns running in one direction are bicomponent sheath/core elastomeric monofilament yarns wherein the sheath has a melting point below that of the core. The bicomponent yarns are melt bonded to yarns running in a perpendicular direction by melting of the sheath. The woven base fabric is joined to a knit cover fabric by an elastomeric bond preferably formed through the lamination of an elastomeric adhesive web between the cover fabric and the base fabric.

18 Claims, 2 Drawing Sheets

FIG. –1–

COMPOSITE TEXTILE STRUCTURE

RELATED APPLICATIONS

This application is a continuation of pending prior application Ser. No. 08/744,176, filed on Nov. 5, 1996, now abandoned of George C. McLarty III for COMPOSITE TEXTILE STRUCTURE.

FIELD OF THE INVENTION

This invention relates generally to support fabric for disposition across a furniture frame and relates more particularly to a composite textile structure including a base fabric of woven elastomeric yarn, a surface fabric of knit polyester and an elastomeric adhesive web disposed between the base fabric and the surface fabric. Such textile structure provides stretch and recovery via the base fabric while providing a surface which may be made smooth so as to have a pleasing surface feel to the user while at the same time being suitable to undergo transfer printing or dyeing operations to impart aesthetically pleasing surface designs.

BACKGROUND OF THE INVENTION

Traditional seating and bedding structures typically are constructed from a frame, a surface fabric for contact with the user, and some type of support member. Typical support members have included springs, webs, straps, or molded units (e.g. thick foam pads). Materials for construction of such support members have been steel, burlap, canvas, plastic and elastomeric strapping and synthetic textile materials. One such synthetic textile material is disclosed in U.S. Pat. No. 4,469,738 to Himelreich, Jr. the teaching of which are incorporated herein by reference.

As will be readily appreciated, the use of a multiplicity of components (i.e. covers and separate support materials) which must be attached to a frame structure gives rise to a relatively complicated assembly practice. Moreover, in a number of applications such as portable beds or wheel chairs which must be suitable to be folded and transported away for storage, it is undesirable to have thick support structures such as foam, springs, and the like as these impede portability and storage. In addition, in many applications including wheel chairs and temporary hospital beds, it is desirable for the overall structure to be easily and thoroughly cleaned without the possibility of retention of contaminating fluids such as blood, urine, and the like. At the same time, the users of such furniture in these environments must be provided with good support and a high degree of comfort generally associated with the more complicated spring and cushion configurations.

In order to reduce the number of components in seating structures and to reduce the bulk thereof, it has been proposed to provide thin profile seats, including thin seats using elastomer seat backing material. One such seating structure is disclosed in my U.S. Pat. No. 5,533,789 (incorporated by reference). In U.S. Pat. No. 2,251,318 to Blair et al., solid rubber tape or strips reinforced by fabric are stretched over a seating frame. In U.S. Pat. No. 4,545,614 to Abu-Isa et al., (incorporated by reference) a thin profile seat is disclosed in which a multiplicity of side by side elastomeric filaments made from a block copolymer of polytetramethylene terephthalate polyester and polytetramethylene ether are stretched across a vehicle seat frame. U.S. Pat. No. 4,869,554 to Abu-Isa et al. (incorporated by reference) discloses a thin profile seat in which elastomeric filaments like that of U.S. Pat. No. 4,545,614 are woven together to form a mat. The mat was prestretched to at least 5% elongation and attached to the seat frame. U.S. Pat. No. 5,013,089 to Abu-Isa et al. (incorporated by reference) discloses a seat assembly having an elastomeric filament suspension and a fabric cover. The filament suspension and the fabric cover are integrated by having the elastomeric filaments in the fabric knitted together to provide a low profile finished seat or backrest.

The present invention provides a textile structure suitable for use as a furniture support sling for applications such as wheel chairs, hospital waiting room chairs and portable beds which provides a high degree of comfort and performance. Such comfort and performance is achieved by combining woven and knitted fabric structures in a manner which provides for the stretch and recovery characteristics desirable for these applications. At the same time, the fabric may be cleaned of contaminating fluids and has a surface which may be transfer printed to yield a visually appealing appearance while nonetheless having a smooth feel which helps to minimize skin shear thereby adding to the overall comfort of the user. Accordingly, the present invention represents a useful advancement over the state of the art.

OBJECTS AND SUMMARY OF THE INVENTION

In light of the foregoing, it is a general object of the present invention to provide a textile structure suitable for use as a furniture support sling having stretch and recovery performance characteristics providing comfort to the user, while at the same time, having good stain resistance and cleanability.

It is feature of the present invention to combine a base fabric formed from elastomeric yarn with a knit surface fabric so as to obtain the stretch and recovery characteristics of the base fabric and the aesthetic and surface feel characteristics of the surface fabric.

It is an additional feature of the present invention to join a base fabric woven from an elastomeric yarn to a warp knit surface fabric by means of an elastomeric adhesive web disposed between the base fabric and the warp knit surface fabric.

It is a preferred feature of the present invention to provide the textile structure with a flourocarbon treatment.

It is yet an additionally preferred feature of the present invention that the knit surface fabric of the composite textile structure be dyed or transferred printed.

In accordance with the present invention a composite textile structure for use as a furniture support sling is provided. The composite structure includes a woven base fabric having a plurality of yarns running in a first direction and a plurality of yarns running in a second direction substantially perpendicular and in crossing relation to the yarns in the first direction. The yarns running in the first direction are preferably of a bicomponent sheath/core elastomeric monofilament construction wherein the sheath has a melting point below that of the core. The yarns running in the second direction are preferably elastomeric monofilament intermingled with a textured polyester. The yarn running the first direction is preferably joined to the yarn running in the second direction by a melting of the sheath material. The woven base fabric is joined to a knit cover fabric by an elastomeric bond which is preferably formed through the lamination of an elastomeric adhesive web between the cover fabric and the base fabric.

In another aspect of the present invention a seating structure such as a wheel chair or waiting room seat utilizing the textile composite of the present invention is provided.

In yet a further aspect of the present invention, a bed such as a medical gurney or the like utilizing the textile composite of the present invention is provided.

Additional objects, advantages and features of the present invention will become apparent upon reading the following detailed description and upon reference to the drawings below.

While the invention has been illustrated and will be described in connection with certain preferred embodiments and procedures, it is, of course, to be appreciated that there is no intention to limit the invention to such particularly illustrated and described embodiments and procedures. On the contrary, it is intended to include all alternatives modifications, and equivalents as may be included within the true spirit and scope of the invention.

DESCRIPTION OF THE PREFERRED EMBODIMENTS

Figure 1:
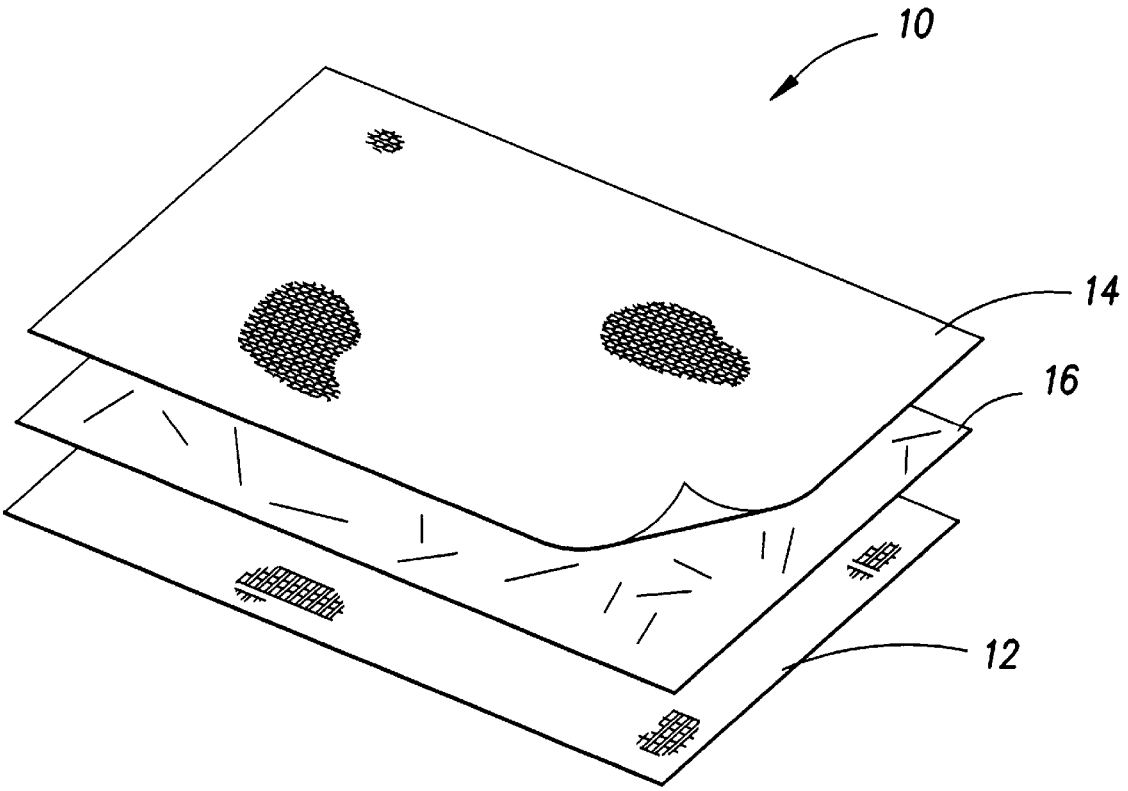
FIG. 1 is a perspective view of the component elements in a potentially preferred embodiment of the composite textile structure according to the present invention.

Turning now to the figures, wherein like reference numerals designate like elements in the various views, in FIG. 1 there is shown a potentially preferred construction of the composite textile structure 10 of the present invention. More particularly, there is illustrated a woven elastomeric base fabric 12, a knit cover fabric 14 and an elastomeric adhesive web 16 disposed between the base fabric 12 and the cover fabric 14.

Figure 2:
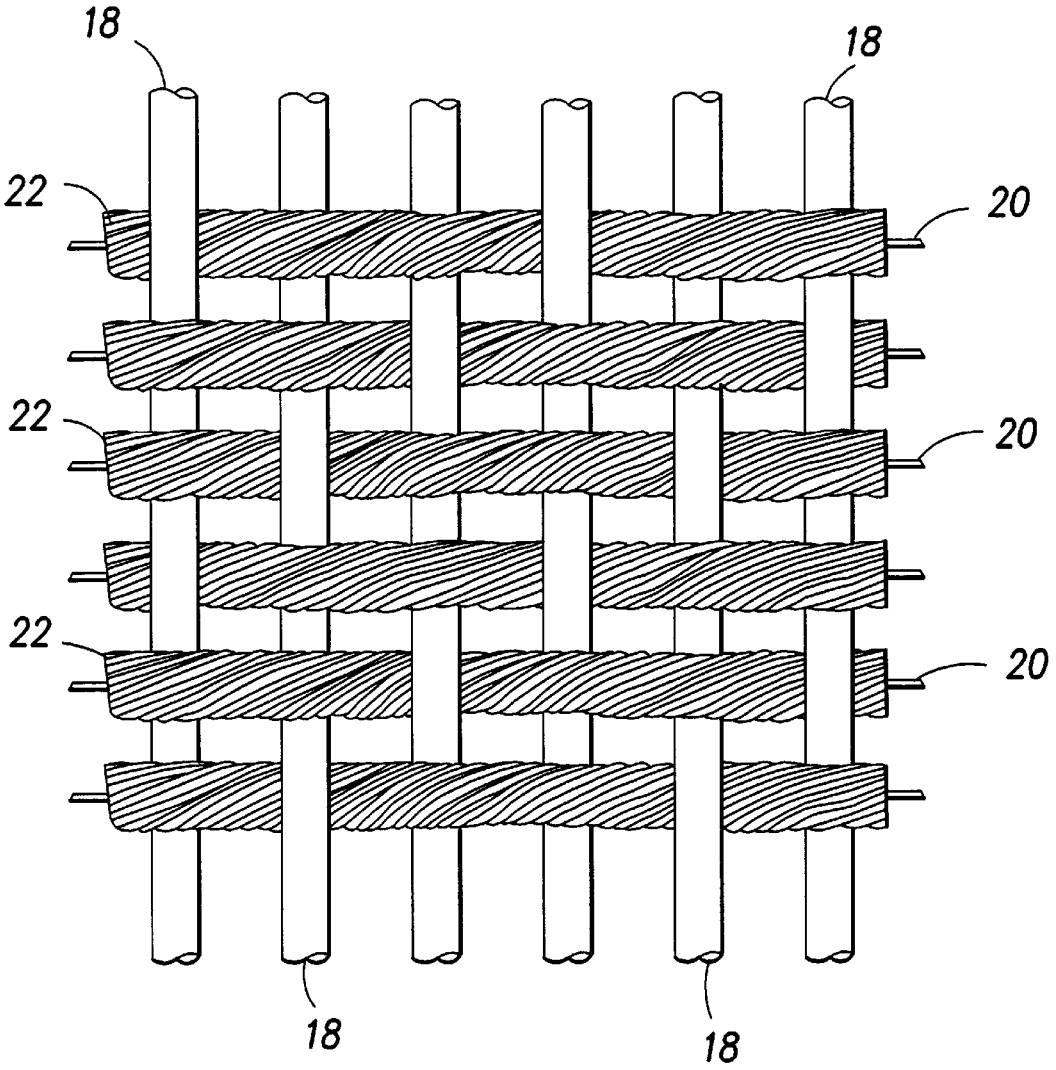
FIG. 2 is a view of a woven base fabric formed of elastomeric yarns according to a potentially preferred embodiment of the present invention.

In FIG. 2 there is illustrated a potentially preferred construction for the elastomeric base fabric 12 for use in the composite textile structure of the present invention. In the illustrated and potentially preferred embodiment, the base fabric 12 includes a plurality of bicomponent sheath/core elastomeric monofilament yarns 18 disposed in crossing relation to a plurality of lower denier elastomer monofilament yarns 20 which are preferably intermingled with a textured fiber 22 such as polyester. Such intermingled yarn is produced by Grover Industries in Grover, N.C.

In the potentially preferred practice, the yarns 18, 20 are disposed in overlying and underlying disposition to one another by weaving processes as are well known to those of skill in the art. The bicomponent sheath/core elastomeric monofilament yarn 18 is preferably disposed in the warp direction with the lower denier elastomeric monofilament yarn 20 being disposed in the filling direction. In the preferred practice the bicomponent monofilament will have a linear density of about 2,250 denier. In the most preferred embodiment the sheath is a 640 durameter polymer having a melting point of about 180° C. and the core is a 672 durameter polymer having a melt point of about 214° C. The elastomeric monofilament 20 preferably has a linear density of about 400 denier and is intermingled with textured polyester 22 to yield an overall structure having a linear density of about 1860 in the final filling yarn. Both the warp yarn and the elastomeric component of the filling yarn of the preferred construction are purchased from Hoechst Celanese Fibers Corporation group in Charlotte, N.C. under the trade designation ELAS-TER™ monofilament.

In the potentially preferred embodiment of the present invention, the elastomeric base fabric 12 is woven in a greige state at about 23 ends per inch by about 20 picks per inch. In the preferred practice, the bicomponent sheath/core elastomeric monofilament yarn 18 is melt bonded to the fill yarn through application of heat on a tenter such that the sheath of the bicomponent monofilament 18 partially melts and creates a bond at crossing points between the two yarn systems. In the potentially preferred practice, the temperature setting on the tenter is 395° F. with a fabric dwell time of about 3 minutes. The fabric resulting from this operation preferably has a weave construction of about 22 ends per inch by about 20 picks per inch.

As previously indicated, in the preferred embodiment of the present invention, the composite textile structure 10 includes a knit cover fabric 14. The knit cover fabric 14 is preferably a three bar warp knit fabric wherein the Bar 1 yarn is used as a float yarn with a stitch notation of 1-0/3-4//. The Bar 1 yarn is most preferably a 70 denier Dacron yarn having 34 filaments per yarn which is purchased from E. I. du Pont de Nemours having a place of business at Wilmington, Del. The Bar 2 yarn and Bar 3 yarn are preferably monofilament polyester yarns having a linear density of about 20 denier disposed in the fabric in opposing tricot stitch orientations. Specifically, in the potentially preferred embodiment the stitch notation for the Bar 2 yarn is 1-0/1-2// and the stitch notation for the Bar 3 yarn is 1-2/1-0//. Bar 1, Bar 2, and Bar 3 are each preferably threaded full yielding a knit construction on the machine of about 56 courses per inch by about 28 wales per inch which is thereafter finished and heat set to yield a final knit construction of about 60 courses per inch by about 39 wales per inch and a final weight of about 5.2 ounces per square yard.

As illustrated in FIG. 1, in the preferred embodiment of the present invention, an elastomeric adhesive web 16 is disposed between the elastomeric base fabric 12 and knit cover fabric 14. In the most preferred embodiment, the elastomeric adhesive web 16 serves to bond the elastomeric base fabric 12 to the knit cover fabric 14. As will be appreciated, in order to realize the benefits of the elastomeric properties in the base fabric 12, the adhesive web 16 should not unduly inhibit the stretch of the overall composite. Moreover, a strong bond should be formed between the adjacent layers without unduly restricting air flow through the composite. For use in applications as sling fabrics in wheelchairs and portable beds, it is believed that good air flow substantially improves the comfort of the user. Accordingly, the present invention preferably has an air permeability of not less than about 20 cubic feet per minute per square foot at a differential air pressure of 125 Pa, and more preferably has an air permeability of at least 40 cubic feet per minute per square foot at a differential pressure of 125 Pa. One material believed to be appropriate for use as the elastomeric adhesive web 16 is believed to be available through Spunfab Inc. having a place of business at 1121 Tower Drive, Akron, Ohio 44305 under the trade designation PB7435.

In the preferred practice, the elastomeric adhesive web 16 is bonded between the elastomeric base fabric 12 and the knit cover fabric 14 by means of heat and pressure applied on an adhesive lamination range. The cover fabric is preferably run with the technical face up (i.e. away from the adhesive web) so that the relatively smooth technical face will contact the user thereby enhancing comfort. In the preferred practice, the machine settings are 200° C. on all heat zones with a speed setting of 4 yards per minute, a pressure setting of 18 Newtons per square centimeter, and a zero height setting.

As indicated previously, in order to enhance the cleanability of the composite textile structure 10, a fluorocarbon surface treatment is utilized. A 5% solution of a fluorochemical composition available from Milliken Chemical in Spartanburg, S.C. under the trade designation BK-96 is padded onto the fabric and cured at a temperature of about 380° F. for a period of about 1 minute. An antimicrobial and/or antifungal agent to prevent the growth of microorganisms such as are known to those of skill in the art may also be added.

In an interesting feature of the present invention, it has been found that the knit cover fabric with fluorocarbon treatment is suitable for direct transfer printing without the need for additional film forming polymer coatings. As explained in U.S. Pat. No. 5,565,265 to Rubin et al. (incorporated by reference) transfer printing is generally known in the art and involves the transference of color designs mounted on paper carriers to the fabric face. In practice, color prints on a paper carrier are made to come in continuous contact with the fabric, and while in contact with the fabric, pressure is applied to produce a calendaring effect. In the preferred practice of the present invention, the roll pressure is in the range of about 30 pounds to 60 pounds with heat applied at about 380° F. to 405° F. with a dwell time of about 15 seconds to about 30 seconds.

As will be appreciated, the present invention provides a composite textile structure of use as a furniture support sling having a number of benefits and advantages including elasticity and recovery, stain resistance, cleanability and printability. While specific embodiments of the invention have been shown and described, it will be understood that the invention is in no way limited thereto, since modifications may be made and other embodiments of the principals of this invention will occur to those of skill in the art. Therefore, it is contemplated by the appended claims to cover any such modifications or other embodiments as incorporate the features of the present invention within the true spirit and scope thereof.

What is claimed is:

1. A composite textile structure useful as a furniture support sling, the textile structure comprising:

a base fabric having a plurality of yarns running in a first direction and a plurality of yarns running in a second direction substantially perpendicular to the yarns in said first direction, wherein the yarns running in said first direction comprise a bicomponent elastomeric monofilament including a sheath component and a core component, the yarns running in said second direction comprising an elastomeric monofilament, said sheath component having a melting temperature below the melting temperature of the core component, said sheath component being melt bonded to the yarns running in said second direction, such that bonds are formed at points of crossover between the yarns running in said first direction and the yarns running in said second direction;

a knit cover fabric; and an elastomeric adhesive web disposed between said base fabric and said knit cover fabric.

2. The composite textile structure as in claim 1, wherein said base fabric is a woven fabric.

3. The composite textile structure as in claim 2, wherein said first direction is the warp direction and said second direction is the fill direction.

4. The composite textile structure as in claim 1, wherein said knit cover fabric is a warp knitted fabric.

5. The composite textile structure as in claim 1, wherein the yarns running in said second direction comprise an elastomeric monofilament intermingled with a textured fiber.

6. The composite textile structure as in claim 5, wherein said textured fiber comprises polyester fiber.

7. The composite textile structure as in claim 1, further comprising a flourochemical surface treatment.

8. The composite textile structure as in claim 7, further comprising a printed design disposed across said knit cover fabric by means of transfer printing without the use of any additional film-forming polymer coatings.

9. A furniture support sling including the composite textile structure of claim 1.

10. A chair, comprising a furniture support sling as in claim 9.

11. A bed, comprising a furniture support sling as in claim 9.

12. A composite textile structure useful as a furniture support sling, the textile structure comprising:

a woven base fabric having a plurality of yarns running in a first direction and a plurality of yarns running in a second direction substantially perpendicular to the yarns running in said first direction, wherein the yarns running in said first direction comprise a bicomponent elastomeric monofilament including a sheath component and a core component and wherein the melting temperature of said sheath component is below the melting temperature of said core component, the yarns running in said second direction comprising an elastomeric monofilament with a textured fiber covering, said sheath component of the yarns running in said first direction being melt bonded to the yarns running in said second direction such that bonds are formed at points of cross-over between the yarns running in said first direction and the yarns running in said second direction;

a warp knitted cover fabric; and an elastomeric adhesive web laminated between said base fabric and said cover fabric.

13. The composite textile structure as in claim 12, further characterized by having an air permeability of not less than 20 cubic feet per minute per square foot of material at a differential pressure of 125 Pascals.

14. The composite textile structure as in claim 13 further comprising a flourocarbon surface treatment.

15. A furniture support sling including the composite textile structure of claim 13.

16. A chair, comprising a furniture support sling as in claim 15.

17. A bed, comprising a furniture support sling as in claim 15.

18. A laminated textile composite, comprising a printed surface fabric and a laminated base structure wherein said surface fabric is flourochemically treated and directly printed by means of transfer printing without any film-forming polymer coating.

* * * * *